US009554596B2

(12) United States Patent
Liu

(10) Patent No.: US 9,554,596 B2
(45) Date of Patent: Jan. 31, 2017

(54) SEALING RING AND ATOMIZER IN ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 924 days.

(21) Appl. No.: 13/901,299

(22) Filed: May 23, 2013

(65) Prior Publication Data

US 2014/0299139 A1 Oct. 9, 2014

Related U.S. Application Data

(63) Continuation of application No. PCT/CN2013/073808, filed on Apr. 7, 2013.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2006.01) |

(52) U.S. Cl.
CPC ..... *A24F 47/008* (2013.01)

(58) Field of Classification Search
None
See application file for complete search history.

(56) References Cited

U.S. PATENT DOCUMENTS 4,640,330 A * 2/1987 Frassica ..... B60B 3/085 152/404

FOREIGN PATENT DOCUMENTS

| | | |
|---|---|---|
| CN | 201479921 U | 5/2010 |
| CN | 201830900 U | 5/2011 |
| CN | 201869778 U | 6/2011 |

OTHER PUBLICATIONS

International Search Report mailed Jan. 16, 2014 in International Application No. PCT/CN2013/073808 filed Jul. 4, 2013.

* cited by examiner

*Primary Examiner* — Michael H Wilson
*Assistant Examiner* — Phu Nguyen
(74) *Attorney, Agent, or Firm* — Tim Tingkang Xia, Esq.; Locke Lord LLP

(57) ABSTRACT

The invention relates to a sealing ring and an atomizer in an electronic cigarette. The sealing ring comprises a bottom cover portion, an outer wall portion which is perpendicular to the plane of the bottom cover and is extended axially from the periphery of the bottom cover, an inhalation hole which is through the central of the sealing ring, an inner wall portion which surrounds the inhalation hole, an circular recess which is located between the inner wall and the outer wall, and at least one reflow hole which is through both the bottom cover and the circular recess. If the sealing ring and the atomizer are adopted in the electronic cigarette, a condensed smoke liquid can reflow back into the atomizer via the sealing ring, and can be heated and further atomized again. The invention can improve efficiency in the use of smoke liquid.

12 Claims, 5 Drawing Sheets

SEALING RING AND ATOMIZER IN ELECTRONIC CIGARETTE

CROSS-REFERENCE TO RELATED APPLICATIONS

This application is a continuation of International Patent Application No. PCT/CN2013/073808, with an international filing date of Apr. 7, 2013, designating the United States, now pending. The contents of these specifications are incorporated herein by reference.

BACKGROUND OF THE INVENTION

Field of the Invention

The invention relates to an electronic cigarettes, and more particularly to a sealing ring and an atomizer in the electronic cigarette.

Related Art

Electronic cigarettes, as one kind of electronic products and smoking simulators, are provided to smokers, in which an electric heating wire heats a smoke liquid and further atomizes the smoke liquid in an electronic cigarette. The heated smoke liquid generates a gaseous smoke which is through a snorkel and an opening of a suction nozzle cover to the external of the electronic cigarette. Usually a sealing ring is provided in an atomizer in the electronic cigarette to prevent the smoke liquid from leaking to the opening of the suction nozzle cover and may being inhaled by smokers.

In the smoking process, the gaseous smoke is easily condensed and changes into a smoke liquid in a cavity adjacent to suction nozzle cover, the condensed smoke liquid in the cavity cannot reflow back into an oil reservoir cotton due to the previous sealing ring insulating the reflow of the smoke liquid in the cavity, which results in the condensed smoke liquid in the cavity being inhaled by smokers.

It is an object of the invention to provide a sealing ring in the electronic cigarette which overcomes the above defects and make the condensed smoke liquid reflow back into an oil reservoir cotton.

SUMMARY OF THE INVENTION

The above and other objects are achieved by the invention as described below:

The program of the invention to solve the above defects is to construct a sealing ring in the electronic cigarette, the sealing ring is provided with an inhalation hole and at least one reflow hole through the sealing ring provided between the inhalation hole and the periphery of the sealing ring.

The sealing ring in the electronic cigarette according to the prevention comprising:

a bottom cover portion; an outer wall portion which is perpendicular to the plane of the bottom cover and is extended axially from the periphery of the bottom cover; an inhalation hole which is through the central of the sealing ring; an inner wall portion which surrounds the inhalation hole; an circular recess which is located between the inner wall and the outer wall; and at least one reflow hole which is through both the bottom cover and the circular recess.

The sealing ring in the electronic cigarette according to the invention, the bottom cover is provided with a plurality of spaced reflow holes through the bottom cover and the circular recess.

The sealing ring in the electronic cigarette according to the invention, the reflow holes are spaced evenly and distributed in the circular recess as same radial direction.

The sealing ring in the electronic cigarette according to the invention, the reflow holes can be one or more of the curved holes, circular holes, elliptical holes, or polygonal holes.

The sealing ring in the electronic cigarette according to the invention, the outer end surfaces of the outer wall and the inner wall are respectively configured with chamfered.

An atomizer in the electronic cigarette according to the invention is provided, the atomizer comprising:

a casing; a sealing ring provided in the casing, the sealing ring having an inhalation hole; a condensation cavity, and a reservoir cavity of liquid smoke, they are provided in the casing and respectively located at the two sides of the sealing ring, an oil absorption material provided in the reservoir cavity, wherein at least one reflow hole through the sealing ring is provided between the inhalation hole and the periphery of the sealing ring, and the reflow hole is communicated with the reservoir cavity and the condensation cavity.

The atomizer in the electronic cigarette according to the invention, the atomizer comprises a external threaded sleeve, a positive electrode, an insulating ring, an atomization seat, an electric heating wire assembly, a snorkel, and an oil reservoir cotton, they are all provided in the casing; the atomizer in the electronic cigarette further comprises the sealing ring provided at the bottom end of the oil reservoir cotton, and a suction nozzle cover sheathed with an end of the casing which is far away from the external threaded sleeve, the suction nozzle cover and the sealing ring form the condensation cavity; the reflow hole provided in the sealing ring is communicated with the oil reservoir cotton and the condensation cavity.

The atomizer in the electronic cigarette according to the invention, the suction nozzle cover comprises a cover plate portion having a central hole, and an outer wall portion which is perpendicular to the plane of the cover plate and is extended axially from the periphery of the cover plate; the outer surface of the outer wall is sheathed with the inner surface of the casing; the suction nozzle further comprises an inner wall portion which surrounds the central hole, a second circular recess which is located between the inner wall and the outer wall of the suction nozzle cover, and the condensation cavity which is formed by the second circular recess and the sealing ring in the electronic cigarette.

The atomizer in the electronic cigarette according to the invention, the sealing ring comprises a bottom cover portion, an outer wall portion which is perpendicular to the plane of the bottom cover and is extended axially from the periphery of the bottom cover, an inhalation hole which is through the central of the sealing ring, an inner wall portion which surrounds the inhalation hole, an circular recess which is located between the inner wall and the outer wall, and at least one reflow hole which is through both the bottom cover and the circular recess.

The atomizer in the electronic cigarette according to invention, the bottom cover of the sealing ring is provided with a plurality of spaced reflow holes through the bottom cover and the circular recess.

The atomizer in the electronic cigarette according to the invention, the reflow holes are spaced evenly and distributed in the circular recess as same radial direction.

The atomizer in the electronic cigarette according to the invention, the reflow holes can be one or more of the curved holes, circular holes, elliptical holes, or polygonal holes.

The atomizer in the electronic cigarette according to the invention the outer end surfaces of the outer wall and the inner wall of the sealing ring are respectively configured with chamfered to assist insertion into the casing and the snorkel.

The sealing ring and the atomizer in the electronic cigarette according to the invention, the condensed smoke liquid can reflow back into the atomizer via the sealing ring, and can be heated and further atomized again. Since the oil reservoir cotton in the atomizer has strong adsorption for the smoke liquid, when the gaseous smoke is condensed and changes into a smoke liquid, the smoke liquid can be adsorbed by the oil reservoir cotton, which can prevent the condensed smoke liquid from being inhaled by smokers, while it can improves efficiency in the use of the smoke liquid and reduces waste of smoke liquid.

DETAILED DESCRIPTION

A sealing ring and an atomizer in an electronic cigarette according to the invention will now be described in detail base on a preferred embodiment shown in the accompanying drawings.

Figure 1:
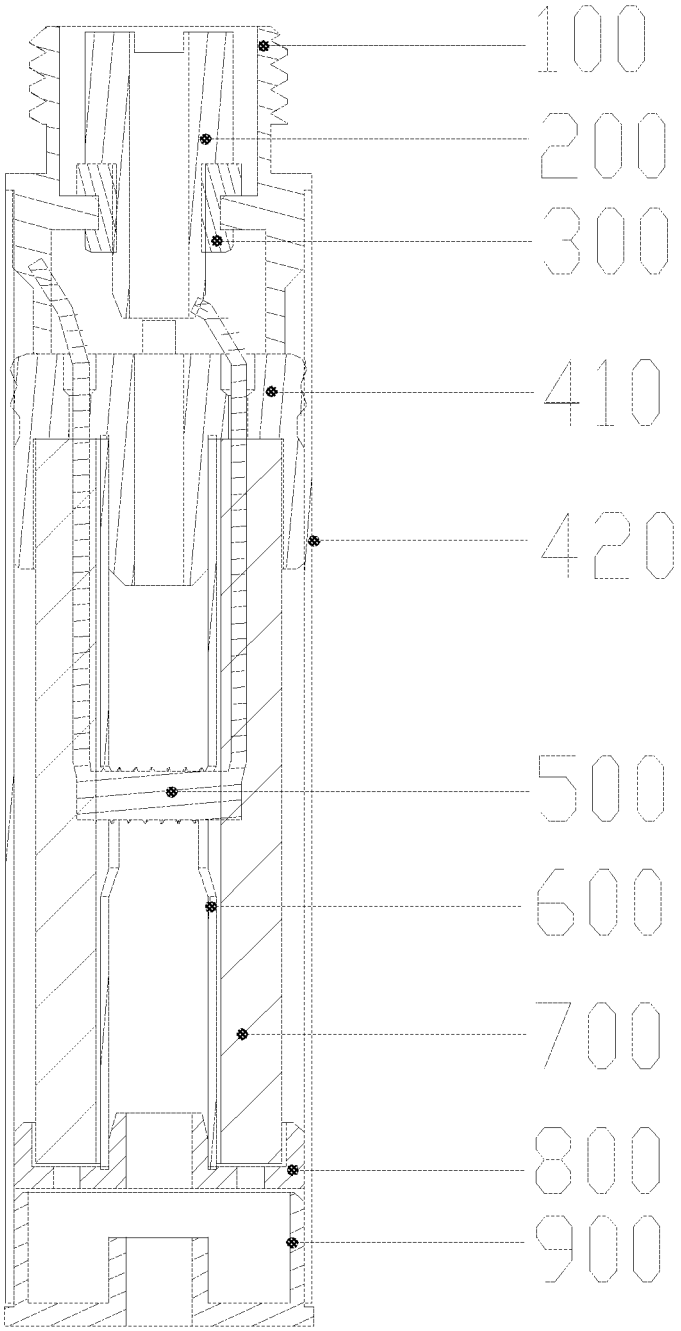
FIG. 1 is a side sectional view of an atomizer in an electronic cigarette according to the invention.
Figure 2:
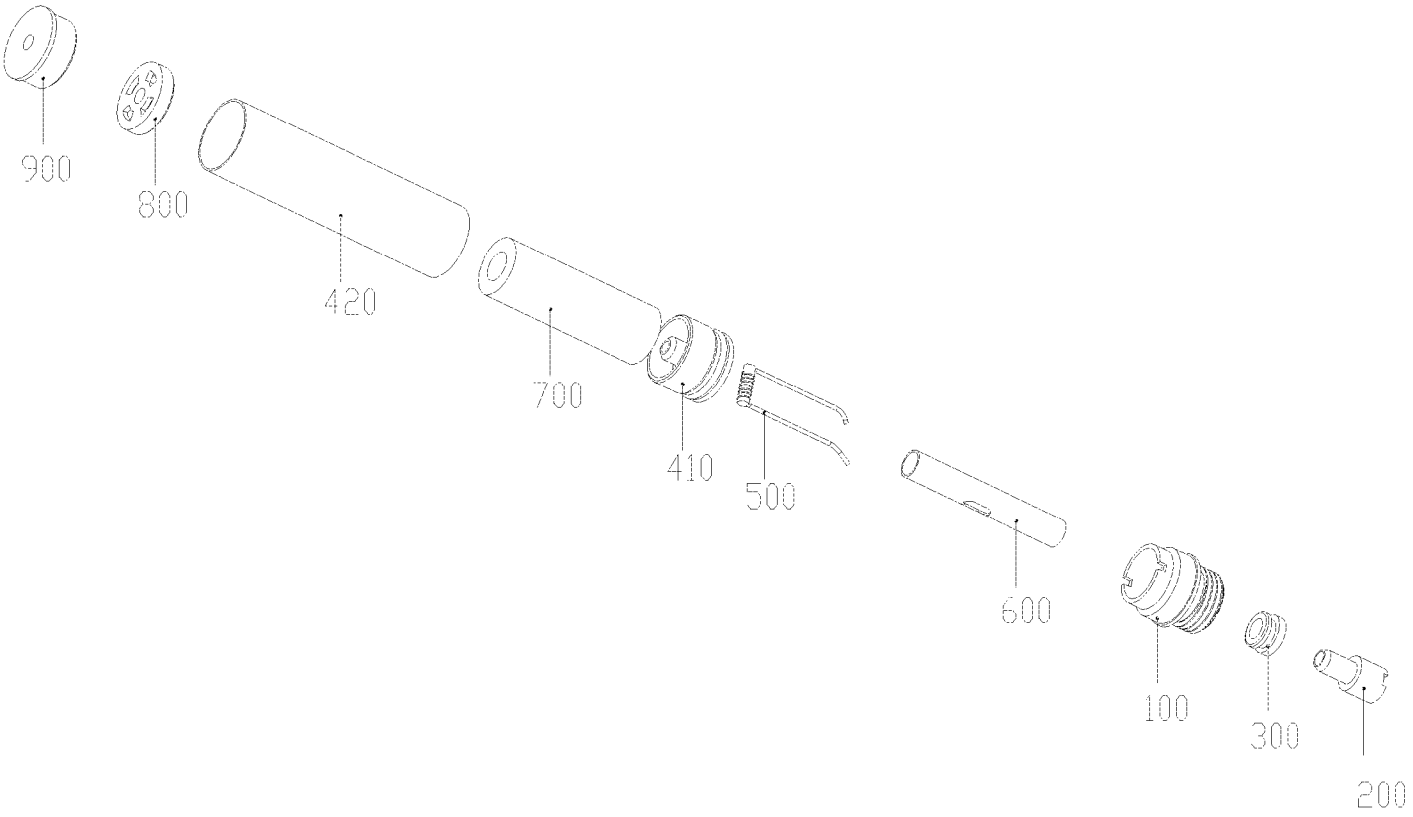
FIG. 2 is an exploded schematic of the atomizer of FIG. 1.

FIGS. 1 and 2 show an atomizer structure provided with a sealing ring of an electronic cigarette according to the prevention. The atomizer comprises an external threaded sleeve 100, a positive electrode 200, an insulating ring 300, an atomization seat 410, an electric heating wire assembly 500, a snorkel 600, an oil reservoir cotton 700, a sealing ring 800 and a suction nozzle cover 900, they are all provided in the casing in order. The insulating ring 300 is provided between the external threaded sleeve 100 and the positive electrode 200 to electrically insulate them each other. The electric heating wire assembly 500 is a "U" shaped frame, two pins of its two ends through the atomization seat 410 is respectively and electrically connected with the positive electrodes 200 and the external threaded sleeve 100. The oil reservoir cotton 700 provided between the atomization seat 410 and the sealing ring 800 is used for storage of smoke liquid. The snorkel 600 provided inside the reservoir cotton 700 has a central through hole. A chamber is formed between the suction nozzle cover 900 and the sealing ring 800.

When the atomizer is in operation, the positive and negative electrodes of external power supply is respectively connected with the positive electrode 200 and the external threaded sleeve 100, the electric heating wire assembly 500 provided in the snorkel 600 converts electrical energy to thermal energy and atomizes a smoke liquid from oil reservoir cotton, the atomized smoke liquid changes into gaseous smoke which follows along the snorkel 600 through the sealing ring 800 and an central hole of suction nozzle cover 900 to the external of the electronic cigarette.

When the gaseous smoke follows through the cavity between the suction nozzle cover 900 and the sealing ring 800, part of the gaseous smoke may be cooled and condenses into a smoke liquid. The condensed smoke liquid can reflow back to the reservoir cotton 700 through reflow holes which are through the sealing ring 800 to the oil reservoir cotton 700.

Figure 3:
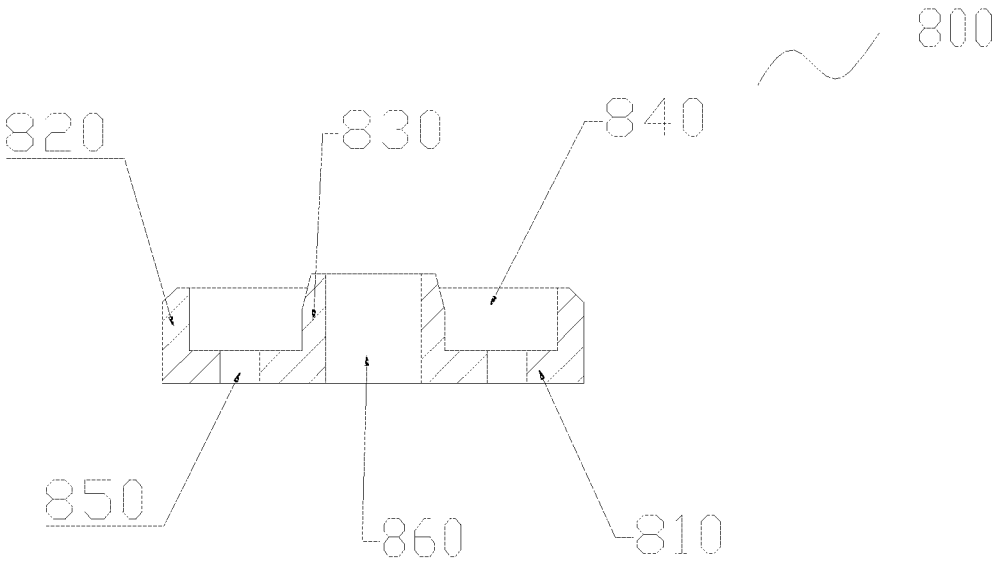
FIG. 3 is a side sectional view of a sealing ring in the electronic cigarette according to the invention.
Figure 4A:
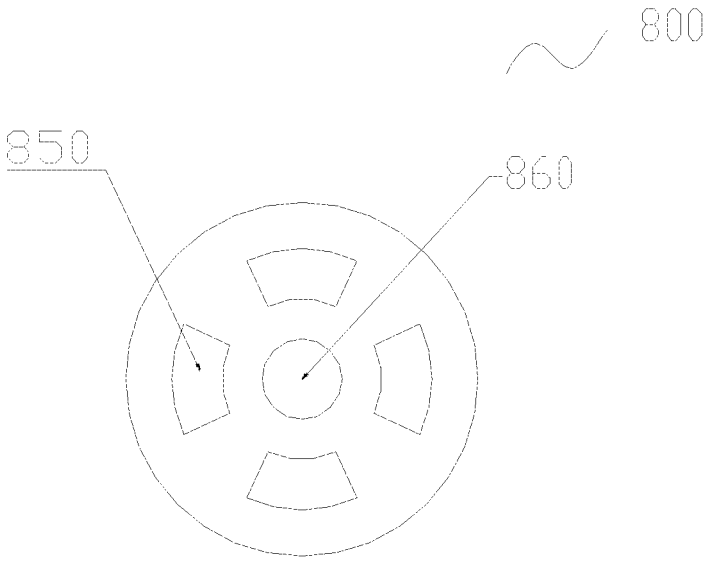
FIG. 4*a* is a bottom view of a first embodiment of a sealing ring in an electronic cigarette according to the invention.
Figure 4B:
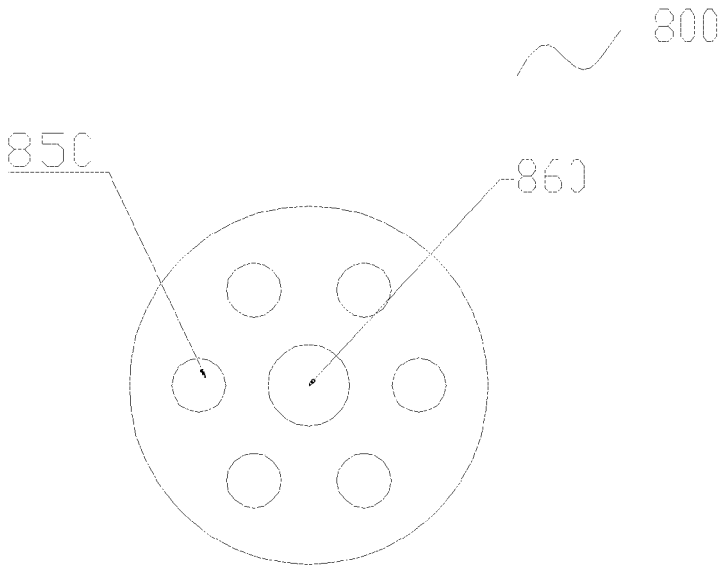
FIG. 4*b* is a bottom view of a second embodiment of a sealing ring in an electronic cigarette according to the invention.
Figure 4C:
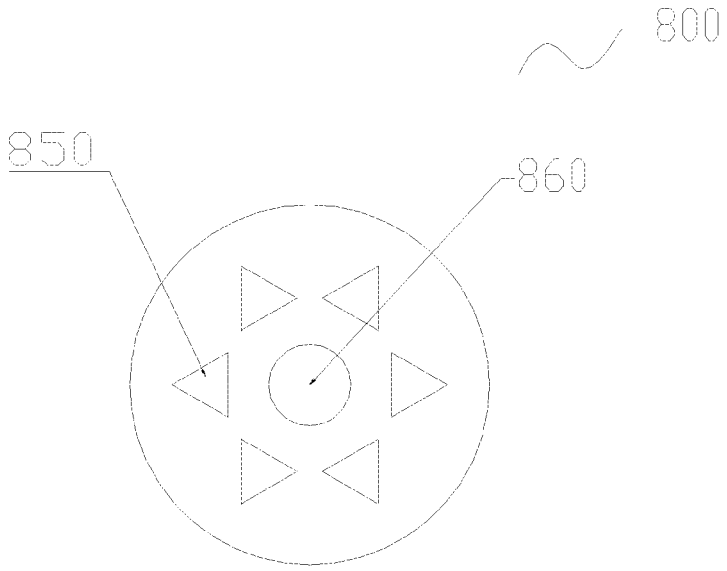
FIG. 4*c* is a bottom view of a third embodiment of a sealing ring in an electronic cigarette according to the invention.

FIG. 3 and FIG. 4.*a* to FIG. 4.*c* show the structure of the sealing ring 800. The sealing ring 800 comprises a bottom cover portion 810; an outer wall portion 820 which is perpendicular to the plane of the bottom cover and is extended axially from the periphery of the bottom cover; an inhalation hole 860 which is through the central of the sealing ring 800; an inner wall portion 830 which surrounds the inhalation hole; an circular recess 840 which is located between the inner wall 830 and the outer wall 820; oil reservoir cotton 700 in which one end of it is tightly embedded in the circular recess 840 and contacted with the inner wall 830, the outer wall 820 and the bottom cover 810; and reflow holes 850 which are through both the bottom cover 810 and the circular recess 840 have the condensed smoke liquid reflow back to the oil reservoir cotton 700.

The shape and quantity of reflow holes 850 can be set according to the actual needs. Referring to FIG. 4.*a*, four curved holes is provided. The four curved holes and the inhalation hole 860 have the same center of the circle In order to ensure the condensed smoke liquid to reflow back equally to the conservator cotton 700. Referring FIG. 4.*b*, six circular holes is provided, the reflow holes 850 also can be changed to elliptical holes, FIG. 4.*b* shows the six circular holes evenly distributed around the inhalation hole 860 to ensure the condensed smoke liquid to reflow back equally to the conservator cotton 700. FIG. 4.*c* shows six reflow holes with equilateral triangle shape evenly distributed around the inhalation hole 860, the equilateral triangle shape of the reflow holes can be changed to a quadrangle, a polygon or an irregular shape.

Figure 5:
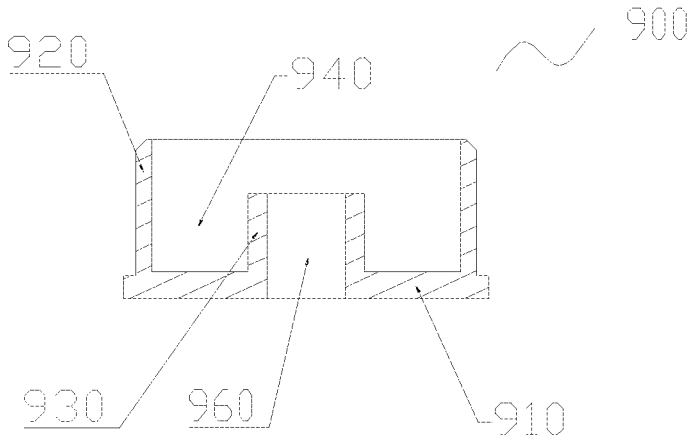
FIG. 5 is a side section view of a suction nozzle cover in an electronic cigarette according to the invention.

FIG. 5 shows the structure of the suction nozzle cover 900, the suction nozzle cover 900 comprises a cover plate portion 910 having a central hole, and an outer wall portion 920 which is perpendicular to the plane of the cover plate and is extended axially from the periphery of the cover plate; the outer surface of the outer wall is sheathed with the inner surface of the casing 420; the suction nozzle further comprises an inner wall portion 930 which surrounds the central hole, a second circular recess 940 which is located between the inner wall 930 and the outer wall 920 of the suction nozzle cover, and the condensation cavity which is formed by the second circular recess 940 and the sealing ring 800 in the electronic cigarette.

The gaseous smoke after being atomized from a smoke liquid flows firstly through the inhalation hole 860 to the condensation cavity, then continually flows from the condensation cavity through the central hole of the suction nuzzle cover 900 to the external of the electronic cigarette, in this process, part of the gaseous smoke may be cooled and condenses into a smoke liquid in the condensation cavity, the condensed smoke liquid can reflow back to the reservoir cotton 700 through reflow holes which are through the sealing ring 800 to the oil reservoir cotton 700, since the oil reservoir cotton 700 has strong adsorption for the smoke liquid, the smoke liquid can be fast adsorbed by the oil reservoir cotton 700, thus the smoke liquid cannot be inhaled by smokers from the central hole.

While the invention has been described by way of example and in term of preferred embodiment, it is to be understood that the invention is not limited thereto. Those who are skill in this technology can still make various alteration and modification without departing from the scope and spirit of this invention. Therefore, the scope of the present invention shall be defined and protected by the following claims and their equivalents.

The invention claimed is:

1. A sealing ring provided in an electronic cigarette, the sealing ring having an inhalation hole, wherein at least one reflow hole is through the sealing ring and is located between the inhalation hole and the periphery of the sealing ring; and wherein the sealing ring further comprises:

a bottom cover portion;

an outer wall portion which is perpendicular to the plane of the bottom cover and is extended axially from the periphery of the bottom cover;

an inhalation hole which is through the central of the sealing ring;

an inner wall portion which surrounds the inhalation hole;

an circular recess which is located between the inner wall and the outer wall; and at least one reflow hole is through both the bottom cover and the circular recess.

2. The sealing ring in the electronic cigarette according to claim 1 wherein the bottom cover is provided with a plurality of spaced reflow holes through the bottom cover and the circular recess.

3. The sealing ring in the electronic cigarette according to claim 2, wherein the reflow holes are spaced evenly and distributed in the circular recess as same radial direction.

4. The sealing ring in the electronic cigarette according to claim 1, Wherein the reflow holes can be one or more of the curved holes, circular holes, elliptical holes, or polygonal holes.

5. The sealing ring in the electronic cigarette according to claim 1, wherein the outer end surfaces of the outer wall and the inner wall are respectively configured with chamfered.

6. An atomizer in an electronic cigarette, the atomizer comprising:

a casing;

a sealing ring provided in the casing, the sealing ring having an inhalation hole;

a condensation cavity and a reservoir cavity of liquid smoke which are provided in the casing and respectively located at the two sides of the sealing ring, an oil absorption material provided in the reservoir cavity;

wherein at least one reflow hole through the sealing ring is provided between the inhalation hole and the periphery of the sealing ring, and the reflow hole is communicated with the reservoir cavity and the condensation cavity;

wherein the atomizer further comprises an external threaded sleeve, a positive electrode, an insulating ring, an atomization seat, an electric heating wire assembly, a snorkel, and an oil reservoir cotton;

wherein the external threaded sleeve, the positive electrode, the insulating ring, the atomization seat, the electric heating wire assembly, the snorkel, and the oil reservoir cotton are provided in sequence inside the casing, the sealing ring is provided at the bottom end of the oil reservoir cotton; and wherein the atomizer further comprises a suction nozzle cover sheathed with an end of the casing which is away from the external threaded sleeve, the suction nozzle cover and the sealing ring form the condensation cavity; the reflow hole provided in the sealing ring is communicated with the oil reservoir cotton and the condensation cavity.

7. The atomizer in the electronic cigarette according to claim 6, wherein the suction nozzle cover comprises a cover plate portion having a central hole, and an outer wall portion which is perpendicular to the plane of the cover plate and is extended axially from the periphery of the cover plate; the outer surface of the outer wall is sheathed with the inner surface of the casing; the suction nozzle further comprises an inner wall portion which surrounds the central hole, a second circular recess which is located between the inner wall and the outer wall of the suction nozzle cover, and the condensation cavity which is formed by the second circular recess and the sealing ring.

8. The atomizer in the electronic cigarette according to claim 6, wherein the sealing ring comprises a bottom cover portion, an outer wall portion which is perpendicular to the plane of the bottom cover and is extended axially from the periphery of the bottom cover, an inhalation hole which is through the central of the sealing ring, an inner wall portion which surrounds the inhalation hole, an circular recess which is located between the inner wall and the outer wall, and at least one reflow hole which is through both the bottom cover and the circular recess.

9. The atomizer in the electronic cigarette according to claim 8, the bottom cover of the sealing ring is provided with a plurality of spaced reflow holes through the bottom cover and the circular recess.

10. The atomizer in the electronic cigarette according to claim 9, wherein the reflow holes are spaced evenly and distributed in the circular recess as same radial direction.

11. The atomizer in the electronic cigarette according to claim 10, wherein the reflow holes can be one or more of the curved holes, circular holes, elliptical holes, or polygonal holes.

12. The atomizer in the electronic cigarette according to claim 8, wherein the outer end surfaces of the outer wall and the inner wall of the sealing ring are respectively configured with chamfered to assist insertion into the casing and the snorkel.

* * * * *